United States Patent [19]

Kobayashi

[11] Patent Number: 4,996,459

[45] Date of Patent: Feb. 26, 1991

[54] CATHODE RAY TUBE FOR COLOR DISPLAY

[75] Inventor: Hiroo Kobayashi, Nagaokakyo, Japan

[73] Assignee: Mitsubishi Denki Kabushiki Kaishi, Tokyo, Japan

[21] Appl. No.: 29,341

[22] Filed: Mar. 23, 1987

Related U.S. Application Data

[63] Continuation of Ser. No. 803,507, Nov. 29, 1985, abandoned, Continuation of Ser. No. 543,620, Oct. 20, 1983, abandoned.

[30] Foreign Application Priority Data

Oct. 29, 1982 [JP] Japan ..... 57-191203

[51] Int. Cl.[5] ..... H01J 29/20; H01J 29/86

[52] U.S. Cl. ..... 313/467; 313/474; 313/480

[58] Field of Search ..... 313/467, 474, 480

[56] References Cited

U.S. PATENT DOCUMENTS

| | | | |
|---|---|---|---|
| 2,757,304 | 7/1956 | Leverenz | 313/467 |
| 4,390,637 | 6/1983 | Daiku | 313/480 X |
| 4,405,881 | 9/1983 | Kobayashi | 313/480 |
| 4,424,467 | 1/1984 | Masuda et al. | 313/467 |
| 4,512,912 | 4/1985 | Matsuda et al. | 313/468 X |

FOREIGN PATENT DOCUMENTS

| | | | |
|---|---|---|---|
| 0050752 | 3/1982 | Japan | 313/480 |
| 0061239 | 4/1982 | Japan | 313/480 |
| 0132647 | 8/1982 | Japan | 313/480 |

OTHER PUBLICATIONS

"Optical Characteristics of Cathode Ray Tube Screens", JEDEC Publication No. 16-B, Aug. 1971, p. 118.

Y. Shimizu et al., "A New Color Picture Tube with Improved Color Fidelity and Contrast," IEEE Transactions on Consumer Electronics, vol. CE-27, pp. 486-492, Aug. 1981.

*Primary Examiner*—Kenneth Wieder

*Attorney, Agent, or Firm*—Lowe, Price, LeBlanc, Becker & Shur

[57] ABSTRACT

A color cathode-ray tube having a face glass (1) coated with a plurality of phosphors (6B, 6G, 6R) different in luminescent color, the face glass (1) containing a colorant imparting a selective characteristic for absorbing light in the wavelength regions between the luminescent wavelength regions of the phosphors, (6B, 6G, 6R) and a colorant suppressing the light transmittance in the visible region, wherein the light transmittances in the luminescent wavelength regions shorter than the highest-visibility wavelength region are at least about 5% lower than the light transmittance in the highest-visibility region, while the light transmittances in the luminescent wavelength regions longer than the highest-visibility wavelength region is higher than the light transmittance in the highest-visibility region.

8 Claims, 4 Drawing Sheets

CATHODE RAY TUBE FOR COLOR DISPLAY

This application is a continuation of application Ser. No. 803,507, filed Nov. 29, 1985, now abandoned which is a continuation of Ser. No. 543,620, filed Oct. 20, 1983, now abandoned.

BACKGROUND OF THE INVENTION

1. Field of the Invention

This invention relates to a color cathode-ray tube mainly for multicolor display of characters and graphics.

2. Description of the Prior Art

Generally, glasses that are used as face plates for cathode-ray tubes are classified into a clear face whose light transmittance in the visible region is 75% or above, a gray face with a light transmittance of 60–75%, and a tint face with a light transmittance of 60% or below. That is, these types of glass are classified by light transmittance.

Heretofore, in the case of color cathode-ray tubes, there has been a tendency to attach more importance to brightness than to contrast. For this reason, the gray face or clear face, which is superior in light transmittance, has been frequently used. On the other hand, in order to absorb ambient light and increase contrast, it is advantageous to use the tint glass, which is low in light transmittance. However, the optical output of color cathode-ray tubes is not generally so strong as to provide sufficient light even if the light transmittance of the glass is lowered. Therefore, it is usual practice to use the clear face or gray face, which is high in light transmittance. In this case, a black matrix type construction is employed.

The curve F1 shown in FIG. 1 indicates the light transmittance-wavelength characteristic of the usual clear face, and F2 indicates the light transmittance-wavelength characteristic of the gray face. It is understood from FIG. 1 that the face plates made of these glasses have substantially flat transmittance characteristics in the visible region.

On the other hand, cathode-ray tubes for color display used to display characters and graphics are very small in light emitting surface area as compared with cathode-ray tubes which are generally used in color television. Therefore, contrast becomes a very important factor, and it is preferable to make the color of the face surface blacker. Thus, as disclosed in U.S. Pat. No. 3,143,683, it is proposed to provide light wavelength selectivity in the light transmittance characteristic of the face plate by adding 0.3–1.5% by weight of a rare earth metal such as neodymium when glass is melted for production of the face plate.

FIG. 2 shows the light transmittance-wavelength characteristic of a 10 mm thick glass sheet having about 1% by weight of neodymium in the form of $Nd_2O_3$ incorporated therein. As is clear from FIG. 2, this glass has large light absorption bands in wavelength regions of about 570–590 nm and 510–530 nm. The light absorption bands in these regions are in the wavelength regions corresponding to the valleys of the emission spectrums of usual red, green and blue phosphors. Therefore, the face plate made of this glass well transmits light in the light emitting wavelength region of each of the red, green and blue fluorescent bodies and well absorbs light in the other wavelength regions. As a result, the contrast of the picture can be improved without decreasing brightness so much, and it is considered possible to greatly increase the chromaticity of each of the primary colors red, green and blue for the purpose of the filter effect of these light absorbing bodies.

Thus, on the basis of this technique, improvements in face glass have been made to provide a cathode-ray tube capable of producing a more easily visible picture. That is, it has been tried to increase contrast while suppressing the light transmittance in the visible region by adding slight amounts of such colorants as chromium, nickel and cobalt in the form of $Cr_2O_3$ amounting to 100 ppm, NiO amounting to 100 ppm, and $Co_3O_4$ amounting to 8–9 ppm. The glass containing such colorants has a characteristic as indicated by a curve A in FIG. 3. Thus, it has become possible to provide a color cathode-ray tube which is excellent in contrast and which is easy to watch.

However, this color cathode-ray tube is excellent in contrast, when combined with phosphors of relatively short persistence called P 22 in the EIA Standard and used for ordinary color television (for example, red $=Y_2O_2S$:Eu, green=ZnS:Au, Cu, Al, blue=ZnS:Ag), has performance excellent in both brightness and contrast. However, in the case of color display, since the picture is almost a stationary one, the flicker becomes a serious problem depending upon the recurrency frequency and quality of the displayed picture. For this reason, for color display use, the often used phosphors which emit green and red light, excluding blue, causing a relatively unobtrusive flicker, are of the long persistence nature, including $Zn_2SiO_4$:MnAs and $(ZnMg)_3(Po_4)_2$:Mn. Of these, green $Zn_2SiO_4$ and MnAs, which are called P 39 in the EIA Standard, have been improved in accordance with recent increasing demands, achieving a degree of brightness which, though not satisfactory, is almost practical. However, concerning red, the light emitting efficiency is low and there is no phosphor which provides sufficient brightness, so that it has been usual practice to use a method of increasing irradiation electron beams to bring them closer to practical brightness, if only to some extent: nevertheless, problems remain as to such points as degradation of the focus characteristics and brightness life of phosphors due to their use under large currents.

SUMMARY OF THE INVENTION

A principal object of this invention is to provide a color cathode-ray tube wherein the aforesaid conventional problems have been eliminated and even if a long persistence type phosphor is used, brightness and contrast can be improved while suppressing flickers, thus ensuring that the pictures are distinct and easy to watch.

In brief, this invention is a color cathode-ray tube having face glass coated with a plurality of phosphors different in luminescent color, said face glass containing a colorant imparting a selective absorption characteristic for absorbing light in the wavelength regions between the luminescent wavelength regions of said phosphors and a colorant suppressing the light transmittances in the visible regions, wherein the light transmittance in those of the luminescent wavelength regions of said phosphors which are shorter than the highest-visibility wavelength region are lower than the light transmittance in said highest-visibility wavelength region by about 5% or more, while the light transmittances in the luminescent wavelength regions longer than said highest-visibility wavelength region are higher than the light transmittance in said highest-visibility wavelength region.

Because of the described construction of the color cathode-ray tube of this invention, even in the case of the flickerless type using a long persistence type red phosphor liable to incur a decrease in brightness, the brightness and contrast of color display can be improved, thus making it possible to provide a color cathode-ray tube which produces distinct easy-to-watch picture.

Other objects and features of this invention will become more apparent from the following description of an embodiment of the invention to be given with reference to the drawings.

DESCRIPTION OF THE PREFERRED EMBODIMENTS

Figure 4:
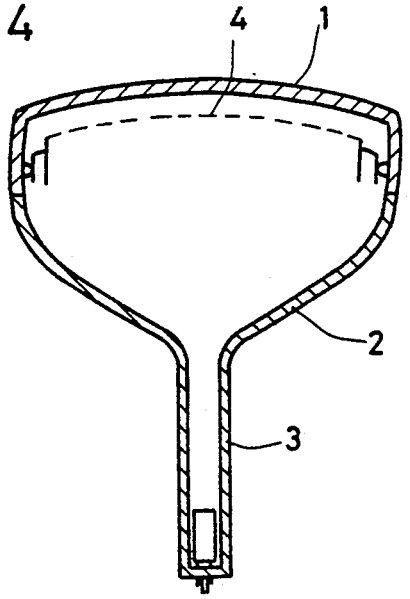
FIG. 4 is a sectional view showing an embodiment of a cathode-ray tube to which this invention is applied.
Figure 5:
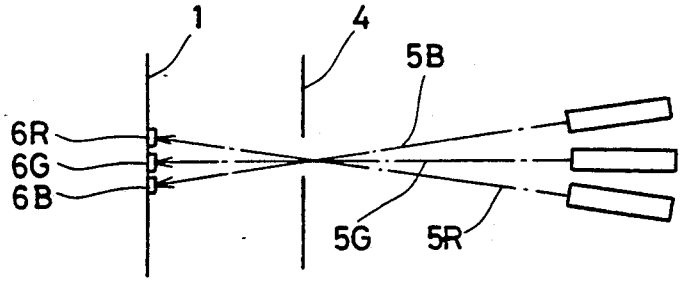
FIG. 5 is a schematic side view showing the relation between phosphors of different luminescent colors, a shadow mask, and electron beams in the cathode-ray tube shown in Fig. 4.
Figure 6:
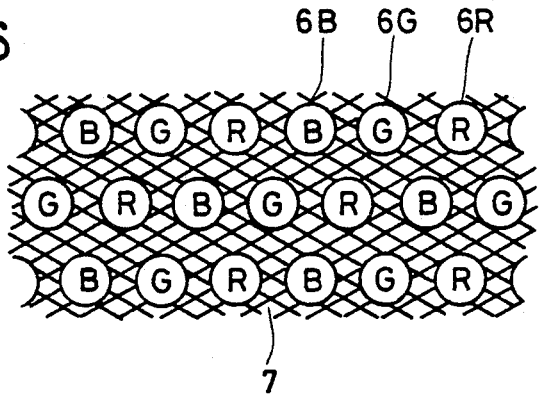
FIG. 6 is a fragmentary plan view showing the disposition of fluorescent dots in the cathode-ray tube shown in FIG. 5.

FIG. 4 is a schematic sectional view showing a typical example of a color cathode-ray tube to which this invention is applied. As is clear from FIG. 4, the color cathode-ray tube comprises a face glass section 1 having phosphors applied to the inner surface thereof, a funnel section 2 joined to said face glass section 1 as by a low-melting solder glass, a neck section 3 housing electron guns, and a shadow mask 4 disposed adjacent the phosphor screen in the interior of a vacuum vessel formed of these portions. The shadow mask is formed with a number of small holes, as shown in a schematic side view in FIG. 5. The shadow mask has the function of a color selection electrode so that electron beams 5*b*, 5*g* and 5*r* passing through these holes with their respective inherent angles strike phosphor dots 6B, 6G and 6R of different colors formed at the points of arrival of the beams. In addition, in the above description, the characters B, G and R suffixed to the reference characters mean blue, green and red, respectively. The resistance surface, as shown in a fragmentary plan view in FIG. 6, is in the form of a black matrix wherein the spaces between the blue, green and red phosphor dots 6B, 6G and 6R are filled with a light absorbing material 7 composed of a black paint. This invention consists in improvements in the construction of the face glass section 1.

Figure 1:
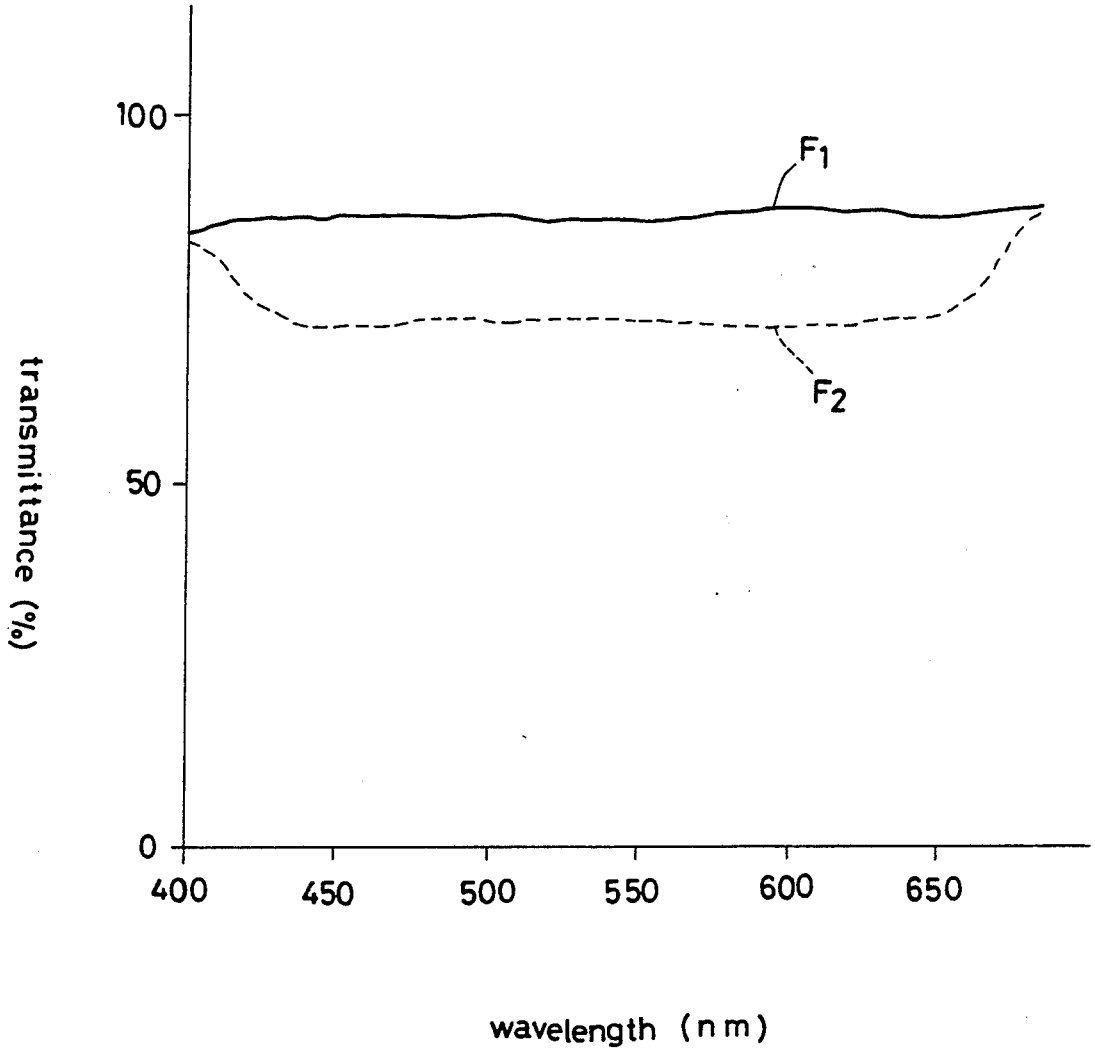
FIG. 1 PRIOR ART
FIG. 1 is a graph showing the light transmittance-wavelength characteristic of conventional color cathode-ray tube face glass.
Figure 2:
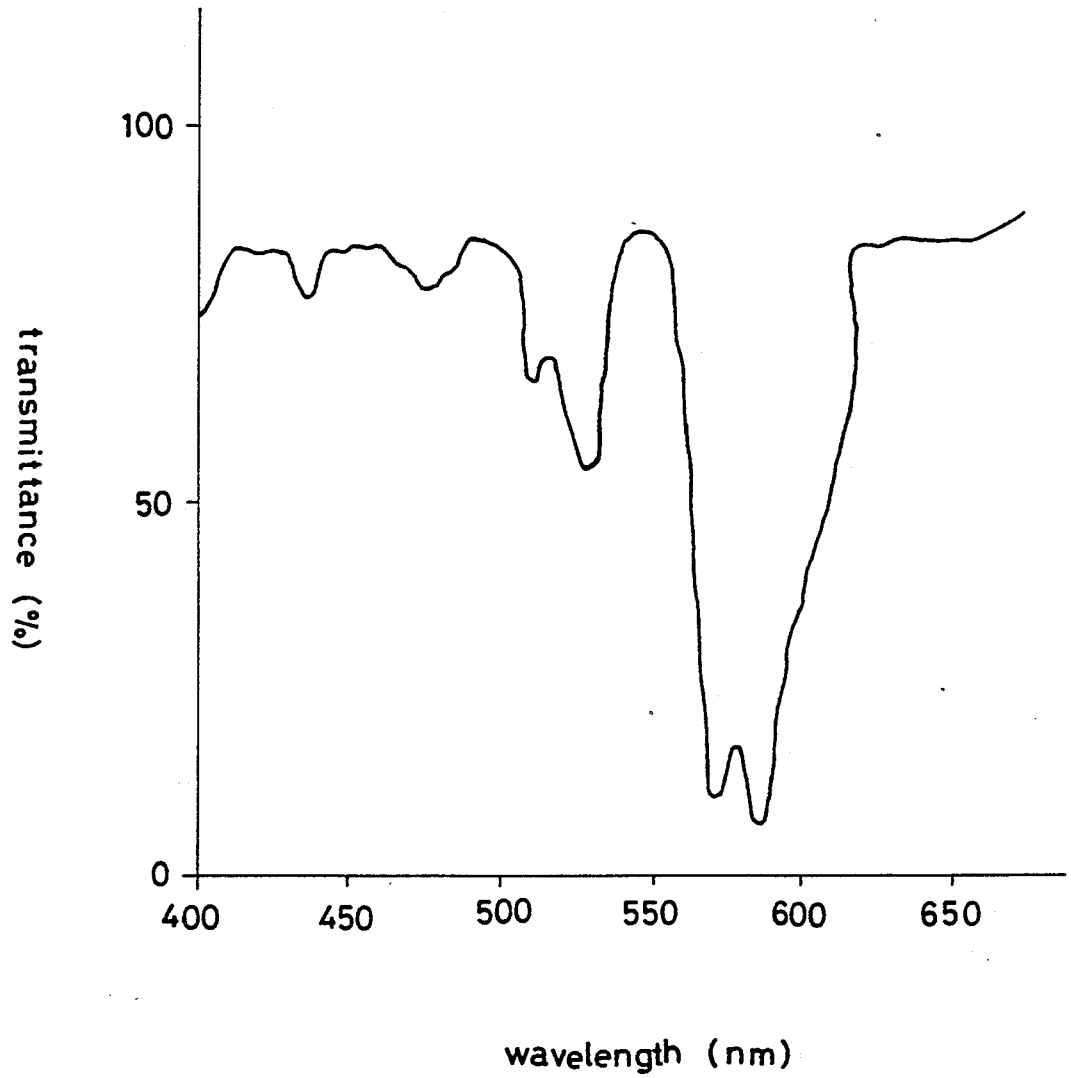
FIG. 2 PRIOR ART
FIG. 2 is a graph showing the light transmittance-wavelength characteristic of 10.0 mm thick, cathode-ray tube face glass containing 1.0% by weight of $Nd_2O_3$.
Figure 3:
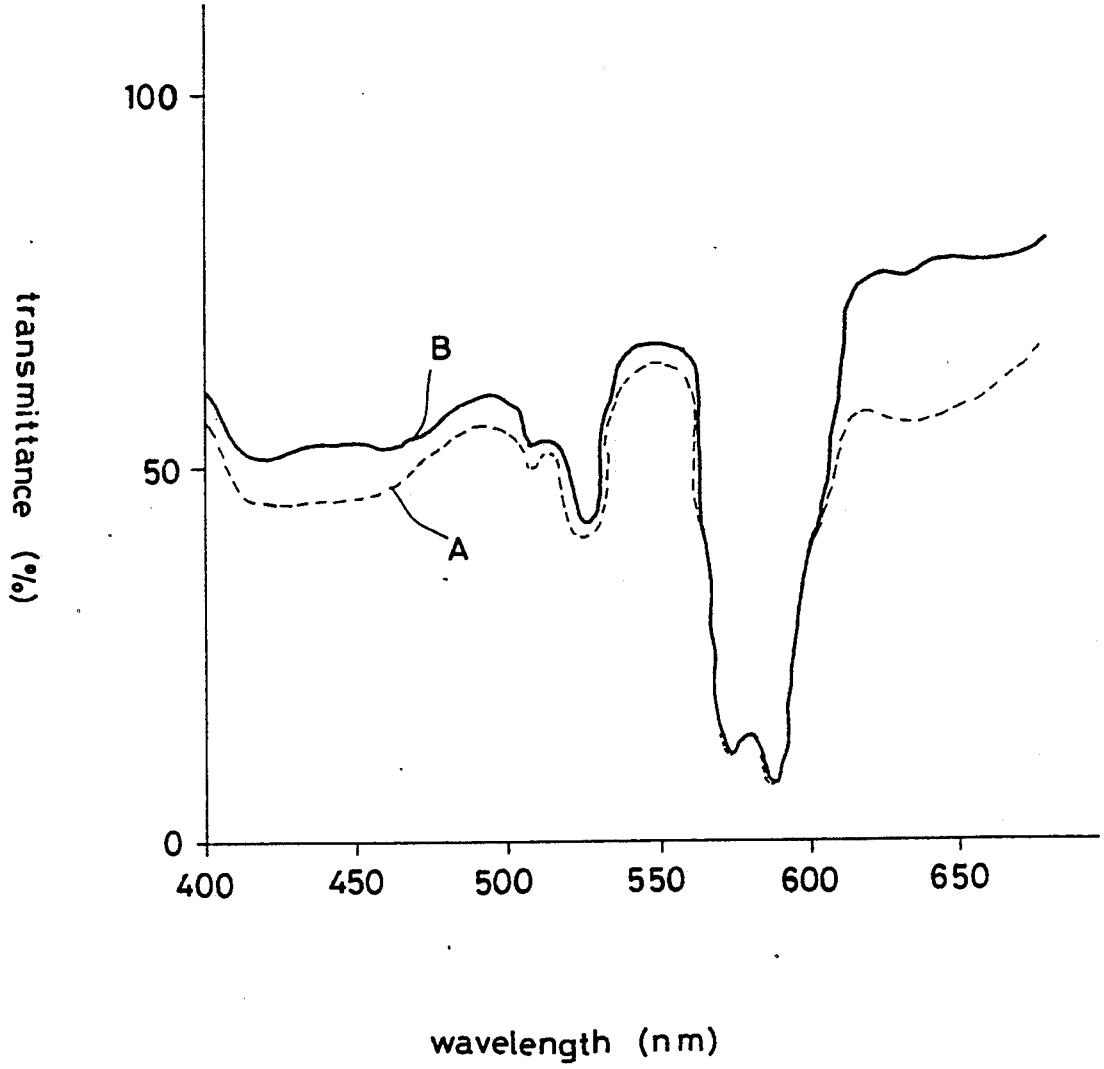
FIG. 3 is a graph showing the light transmittance-wavelength characteristics of glass forming the basis of this invention and glass used in an embodiment of this invention.

As described above, the glass having the light transmittance-wavelength characteristic indicated by the curve A in FIG. 3 is made by adding $Cr_2O_3$, NiO, and $Co_3O_4$ to $Nd_2O_3$. Of these components, $Nd_2O_3$ exhibits strong, light absorption in the vicinity of 570–590 nm and 510–530 nm. Thus, it imparts a selective absorption characteristic to the glass. Further, $Cr_2O_3$ has the function of absorbing blue and red, and NiO has the function absorbing green and red. Therefore, in order to provide the characteristic indicated by the curve A, the amounts of $Cr_2O_3$, NiO, and $Co_3O_4$ to be added are adjusted to establish a balance between the red, green and blue components in the visible region. I have made it possible to suppress the light transmittance in the blue region in the vicinity of 450 nm and to increase the light transmittance in the red region above 590 nm by changing the mixing ratio of the additives by decreasing the amounts of Co and Cr to be added.

Generally, the amount of ambient light diffusion-reflected by the phosphor screen surface provided on the inner surface of the face glass after it has passed through the face glass, which forms the basis for determining contrast, depends largely on the light transmittance in the vicinity of 550 nm where the visibility is highest, though more or less varying with the kind of the source of ambient light. If, therefore, the light transmittance in this region is suppressed to be set within the range of 55–70%, then the influence on the contrast of pictures would be very little as compared with the improvement in brightness even if the light transmittance in the red region above 590 nm is increased.

Thus, as an example, 4–5 ppm of Co, 80 ppm of Cr and 100 ppm of Ni were added, whereby it was possible to realize the characteristic as indicated by the curve B in FIG. 3. That is, the light transmittance at a wavelength of 450 nm in the blue region was set to about 55%, the light transmittance at a wavelength of 550 nm in the green region was set to about 65%, and the light transmittance at a wavelength of 630 nm in the red region was set to about 70%, whereby it became possible to improve the brightness of red by about 30% as compared with the characteristic indicated by the curve A in FIG. 3. Further, experiments have revealed that in the case where the light transmittance in the blue wavelength region besides the light transmittance in the red region is increased while suppressing the light transmittance in the green region alone because of too much importance placed on contrast, the brightness of red can be improved but the drawback is aggravated that the reflection spectrum produced when the phosphor screen of the cathode-ray tube is radiated with ambient light having a different spectral band, e.g., sunlight and light from an incandescent lamp or fluorescent lamp, i.e., the body color of the face portion of the cathode-ray tube looks differently under different conditions. Thus, it is seen that this becomes a great drawback as compared with the previously described case in which the transmittance in the red region alone is increased.

Experiments have revealed that when the light transmittance at a wavelength of 550 nm is used as a reference, it is desirable that the light transmittances in the blue and red regions be at least 5% lower in the vicinity of 450 nm and be the same as or higher than said value in the vicinity of 630 nm; if they are lower than that, no appreciable effect can be expected.

Although the present invention has been described and illustrated in detail, it is clearly understood that the same is by way of illustration and example only and is not to be taken by way of limitation, the spirit and scope of the present invention being limited only by the terms of the appended claims.

I claim:

1. A color cathode-ray tube for a color display, comprising a face glass coated with a plurality of phosphors different in luminescent color, said face glass containing a colorant imparting a selective absorption characteristic for absorbing light in wavelength regions between the luminescent wavelength regions of said phosphors, and a colorant suppressing the light transmittance in the visible region, wherein the light transmittances in those of the luminescent wavelength regions of said phosphors which are shorter than the highest-visibility wavelength region are at least about 5% lower than the light transmittance in said highest-visibility wavelength region, while the light transmittances in the luminescent wavelength regions longer than said highest-visibility wavelength region are higher than the light transmittance in said highest-visibility wavelength region, said light transmittance in the highest-visibility wavelength region being suppressed to lie within the range of about 55–65%, said light transmittance in the luminescent wavelength region longer than said highest-visibility wavelength region being about 70%.

2. A color cathode-ray tube as set forth in claim 1, wherein said colorant imparting said selective absorption characteristic contains neodymium, whereby the light transmittance of the face glass is given a selective absorption characteristic, and there is contained a colorant serving to suppress the light transmittance in the visible region so that the light transmittance at a wavelength of about 450 nm in the blue region is about 55% and the light transmittance at a wavelength of about 550 nm in the green region is about 65% while the light transmittance at a wavelength of about 630 nm in the red region is about 70%.

3. A color cathode-ray tube as set forth in claim 2, wherein said colorant for suppressing the light transmittance in the visible region comprises chromium, nickel and cobalt.

4. A color cathode-ray tube as set forth in claim 3, wherein said neodymium, chromium, nickel and cobalt are contained in the form of $Nd_2O_3$, $Cr_2O_3$, NiO and $Co_3O_4$, respectively.

5. A color cathode-ray tube as set forth in claim 4, wherein the amounts of said $Nd_2O_3$, $Cr_2O_3$, NiO and $Co_3O_4$ contained are about 0.3–1.5% by weight, 80 ppm, 100 ppm and 4–5 ppm, respectively.

6. A color cathode-ray tube as set forth in claim 3, wherein said plurality of phosphors are blue, green and red phosphors.

7. A color cathode-ray tube as set forth in claim 6, wherein said red phosphor is a long persistence type phosphor.

8. A color cathode-ray tube as set forth in claim 7, wherein said red phosphor is $(ZnMg)_3(PO_4)2$:Mn.

* * * * *